United States Patent [19]

Dunahoo

[11] 4,257,309

[45] Mar. 24, 1981

[54] CONTINUOUS FILAMENT ROPE AND METHOD OF MAKING SAME

[75] Inventor: Edmond A. Dunahoo, Long Beach, Calif.

[73] Assignee: Fiber Science, Inc., Utah, Calif.

[21] Appl. No.: 953,864

[22] Filed: Oct. 23, 1978

[51] Int. Cl.[3] ..... D04G 1/00; D04D 1/00; D07B 1/02; D07B 1/22

[52] U.S. Cl. ..... 87/12; 24/115 K; 24/265 EE; 57/21; 57/22; 57/201; 57/202; 87/8; 294/74; 294/77; 428/255; 428/375

[58] Field of Search ..... 57/201, 202, 21, 22; 87/8, 12, 33, 53; 289/1.2, 1.5, 18.1; 294/74, 77; 428/255, 364, 375; 24/115 R, 115 A, 115 K, 115 H, 122.6, 265 R, 265 CD, 265 EE, 265AL

[56] References Cited

U.S. PATENT DOCUMENTS

| | | | |
|---|---|---|---|
| 296,377 | 4/1884 | Atwood | 57/201 X |
| 1,703,269 | 2/1929 | Garris | 57/202 X |
| 1,901,439 | 3/1933 | Drew | 87/8 |
| 2,082,828 | 6/1937 | Garris | 87/8 |
| 2,142,642 | 1/1939 | Garris | 87/8 |
| 2,142,643 | 1/1939 | Garris | 87/8 |
| 2,805,540 | 9/1957 | Thompson, Jr. | 57/201 |
| 3,024,302 | 3/1962 | Coggeshall | 87/8 UX |
| 3,046,045 | 7/1962 | Campbell | 294/74 |
| 3,079,192 | 2/1963 | Otley | 57/202 X |
| 3,222,858 | 12/1965 | Gilmore et al. | 57/201 |
| 3,631,733 | 1/1972 | Thompson, Jr. | 57/201 X |
| 3,692,361 | 9/1972 | Ivarsson | 24/265 EE X |
| 4,119,344 | 10/1978 | Kondo | 24/265 EE X |

FOREIGN PATENT DOCUMENTS

| | | | |
|---|---|---|---|
| 446259 | 9/1912 | France | 294/77 |
| 806349 | 9/1936 | France | 294/77 |

*Primary Examiner*—John Petrakes

*Attorney, Agent, or Firm*—Blakely, Sokoloff, Taylor & Zafman

[57] ABSTRACT

Continuous filament rope and method of making same whereby high strength continuous synthetic filaments may be used to provide a rope which in use will have a strength approaching the theoretical strength of the fibers therein. The rope is made by combining a plurality of filaments and twisting the filament group into a light twine in comparison to the rope ultimately desired. The twine is then impregnated with a suitable flexible resin system and wound in a loop having at least a substantial number of turns of the twine. Thereafter the loop is allowed to twist back on itself in response to the twist initially set in the twine so as to form a rope-like center section with loops at each end thereof. Curing of the flexible resin system results in a suitable flexibility of the rope while providing for abrasion and fraying resistance. The loops at the end of the rope may be looped over hooks or pins when in use, with the resulting strength of the rope approaching that of the combined fiber strength. Lengths of rope may also be looped together to provide longer rope sections with only a small decrease in the resulting strength. The rope may also be woven into two dimensional configurations to form nets. Various methods of manufacturing are disclosed.

34 Claims, 10 Drawing Figures

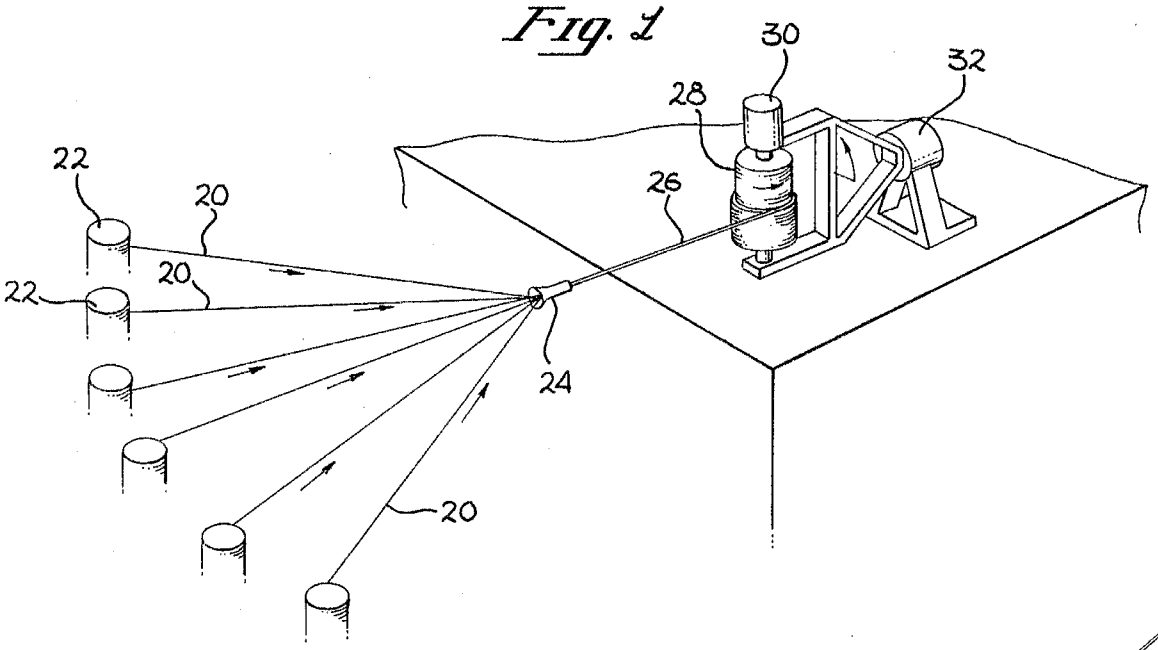
Fig. 1
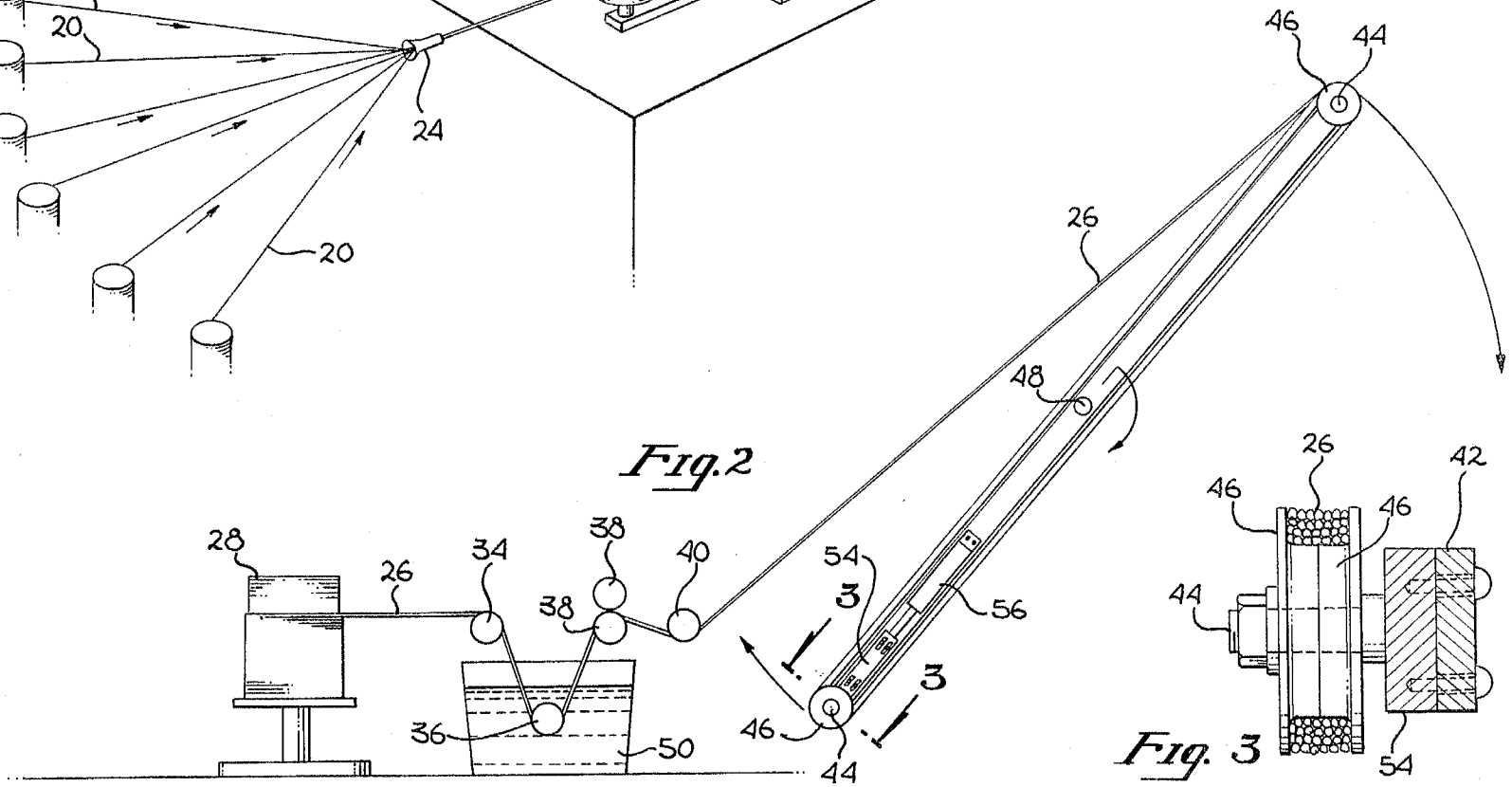
Fig. 2
Fig. 3

Fig. 6
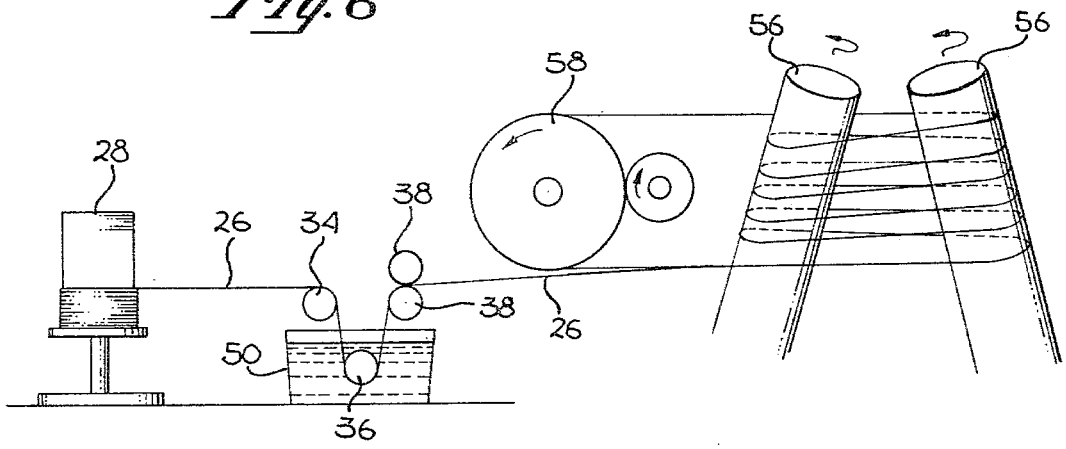
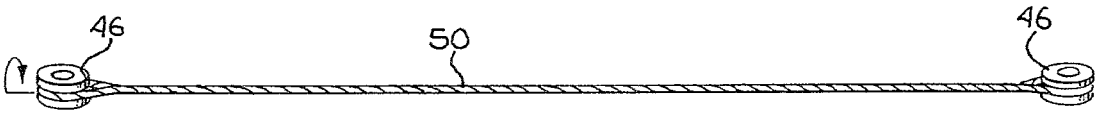
Fig. 4
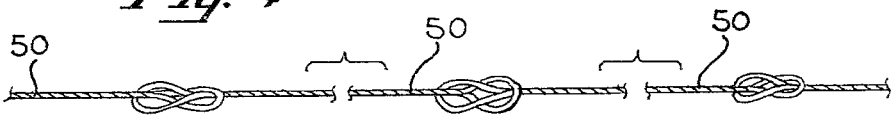
Fig. 7
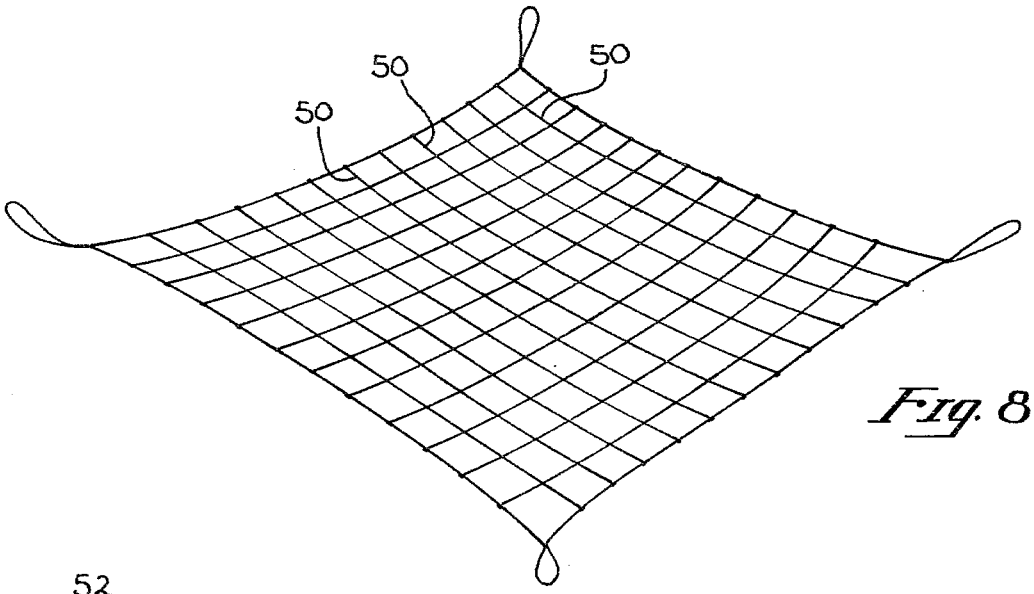
Fig. 8
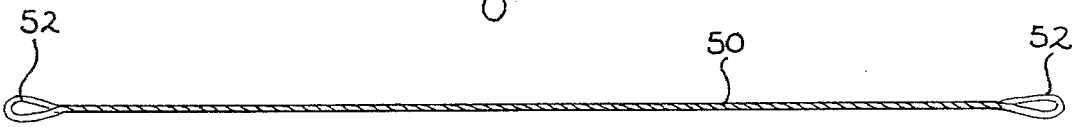
Fig. 5

CONTINUOUS FILAMENT ROPE AND METHOD OF MAKING SAME

BACKGROUND OF THE INVENTION

1. Field of the Invention

The present invention relates to the field of methods and articles of manufacture utilizing continuous filaments.

2. Prior Art

Various techniques for the manufacture of rope are well known in the prior art. Of particular interest for the present invention is conventional or unbraided rope. Such rope may be characterized by groups of fibers or filaments twisted to provide a twine-like cord with three of the twine-like cords being twisted together in the opposite direction to form the rope. (Obviously other techniques are also well known, the foregoing being merely exemplary only.) One of the advantages of having the cords twisted in one direction and wound on themselves in the opposite direction is that the resulting rope has at least a reduced tendency to unwind when subjected to tension. Also the series of twists has the advantage of better distributing loads so that the strength of the rope will better approach the aggregate fiber strength, particularly when curved around the pulley and/or when knotted, though in both cases, particularly when tied in knots, substantial strength reduction is encountered.

For ropes of hemp and the like, techniques for splicing are well known which allow the splicing of two lengths of rope together and the splicing of eyes into the ends thereof. For ropes of synthetic fiber, however, such as nylon, etc. special splicing and knotting techniques generally must be used because of the higher strength and self-lubricating tendencies of the fiber, both of which encourage the pulling out of splices made in accordance with techniques found entirely satisfactory for hemp ropes. For the particular high strength synthetic fibers or filaments such as Kevlar which initially appear particularly attractive for use in rope of conventional construction, such rope has in fact not been used commercially because of the inability to take advantage of the rope's potential strength in any practical application.

If ordinary rope manufacturing techniques are utilized to make rope using synthetic filaments such as Kevlar, a high strength low density material having a strength-to-weight ratio on the order of five times that of steel, the resulting rope potentially has very high strength, though perhaps the abrasion resistance is inadequate for at least some uses. (Kevlar is a trademark of Dupont, used on high strength, low density synthetic filament in the nylon family.) However, in attempting to use such rope, knots reduce the potential strength considerably, with knots having a likelihood of either pulling out under the very high loads achievable or at least jamming so as to not be readily untied. If clamping is attempted rather than knotting, transverse pressure on the fibers reduces the ultimate strength of the rope. Also the rope has a tendency to pull out of such clamps because of the particularly high loads and the inability of a clamp to adequately frictionally engage the rope.

One aspect of the present invention is that the rope is formed with continuous loops at each end thereof so that the potential rope strength may be achieved in actual use by looping the ends of the rope over pins or hooks for retention. The concepts of loops at the ends of a section of cable or rope is shown in U.S. Pat. Nos. 2,199,958; 3,079,192 and 3,222,858. In the '192 patent, a cargo sling is disclosed which is formed of wire rope or the like. The sling is characterized by a rope-like assembly having a loop at each end protected by a sheath. The sling is fabricated by spacing the sheaths as desired and then hooking one end of the rope over one sheath, winding it down around the second sheath, up over the start end of the rope on the first sheath and down again, with the finished end of the rope being tucked between the loop formed by the winding and the second sheath. With this construction the load on the main loops increases the frictional engagement of the rope ends to help avoid slippage thereof. The resulting rope-like assembly is therefore comprised of three lengths of the rope or cable. In the '958 patent, a hoisting sling of generally similar construction is shown with one embodiment being formed of a single length of cable so that the body consists of three cables and the eyes consist of two cables, and the second embodiment being formed of two cables to provide a body formed of four cables and eyes consisting of three cables. The '858 patent, on the other hand, discloses a twisted cable assembly and method of making the assembly which utilizes a single strand of wire looped over a pair of spaced apart pins a substantial number of times, and then twisted about its length to form a central section of twisted wire cable with continuous loops of wire at each end thereof. In an alternate method of making the twisted cable assembly the wire is pre-twisted along its axis so that after winding around the spaced apart pins the untwisting of the individual wires will form the twist of the desired finished cable.

In addition to the foregoing patents, U.S. Pat. No. 3,631,733 discloses an elastic transmission belt of single loop twisted construction, with the looped ends thereof being held together by a metal clip. Also U.S. Pat. No. 4,045,072 discloses an abrasion resistant boot and pendant or sling of wrapped construction.

BRIEF SUMMARY OF THE INVENTION

Continuous filament rope and method of making same whereby high strength continuous synthetic filaments may be used to provide a rope which in use will have a strength approaching the theoretical strength of the fibers therein. The rope is made by combining a plurality of filaments and twisting the filament group into a light twine in comparison to the rope ultimately desired. The twine is then impregnated with a suitable flexible resin system and wound in a loop having at least a substantial number of turns of the twine. Thereafter the loop is allowed to twist back on itself in response to the twist initially set in the twine so as to form a rope-like center section with loops at each end thereof. Curing of the flexible resin system results in a suitable flexibility of the rope while providing for abrasion and fraying resistance. The loops at the end of the rope may be looped over hooks or pins when in use, with the resulting strength of the rope closely approaching that of the combined fiber strength. Lengths of rope may also be looped together to provide longer rope sections with only a small decrease in the resulting strength. The rope may also be woven into two dimensional configurations to form nets. Various methods of manufacturing are disclosed.

BRIEF DESCRIPTION OF THE DRAWINGS

FIG. 1 is a schematic perspective view illustrating the combining of a number of strands into a twine.

FIG. 2 is a schematic representation of the winding of the twine formed in FIG. 1 into a loop.

FIG. 3 is a cross-section taken along line 3—3 of FIG. 2.

FIG. 4 is an illustration of the manner the loop formed in the process of FIG. 2 will wind back upon itself to form a rope.

FIG. 5 is an illustration of a rope formed in accordance with the method of the present invention.

FIG. 6 is an alternate method of forming a loop to allow the manufacture of individual rope lengths of substantial size in a limited space.

FIG. 7 illustrates the manner in which various sections of rope may be looped together to form rope of any desired length.

FIG. 8 is a view illustrating the manner of looping together a number of individual rope sections in a two-dimensional pattern.

DETAILED DESCRIPTION OF INVENTION

Figure 9:
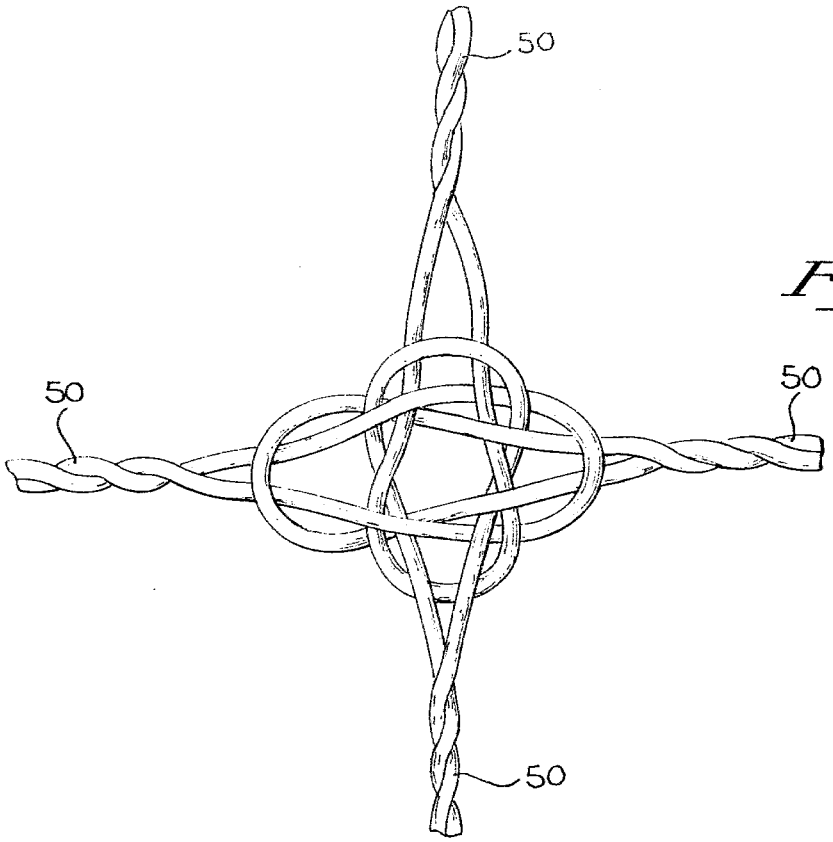
FIG. 9 is an illustration of one form of looping which may be used to form the intersections of the net-like structure of FIG. 8.

First referring to FIG. 1, the first step in the preferred method of manufacture of the rope of the present invention may be seen. In this step a number of multifilament strands 20 are supplied from rolls 22. The strands 20 are pulled through eyelet 24 by takeup drum or ball 28 driven by a suitable drive means 30 for this purpose. Simultaneously, an orthogonal drive system rotates the takeup reel 28 about an axis orthogonal to its own axis so as to twist the strands 20 into a twine 26, with the twine itself being rolled up on the takeup reel 28. Preferably the number of strands combined to form the twine 26 is selected so that the cross-sectional area of the twine is substantial in comparison to the cross-sectional area of individual filaments, though preferably is at most a small percentage of the cross-sectional area of the rope to be made. Also, while twisted strands could be supplied by the rolls 22, good results and infact the preferred form of practicing the invention comprises the use of substantially untwisted strands. The resulting twine 26 when using a high strength synthetic fiber such as Kevlar exhibits a strong tendency of unwinding unless the free ends thereof are restrained.

Once the ball of twine 28 is formed, the twine is then wound in a loop which, if not initially flattened, may be flattened into a loop having a length equal to the length of rope desired to be made, increased by the loss in length that will result from the twisting step to be subsequently described. Thus, as may be seen in FIG. 2, the twine 26 is drawn through a system of rollers or guides 34, 36, 38 and 40 by a yoke-like assembly 42. In particular the yoke-like assembly has a pair of pins 44, as may be best seen in FIG. 3, retaining a pair of mating shaping members 46 for shaping the ends of the coils of twine 26 formed thereon by the rotation of the yoke assembly about its axis 48. Thus, to start the winding a length of the twine 26 may be pulled around each end of the yoke-like assembly 42 and tied to itself, or the starting end may be tied to one end of the yoke assembly to initiate the winding action by the rotation of the yoke assembly about its axis. In this method, a reservoir 50 of suitable flexible uncured resin is provided with guide 36 being located below the surface of the resin therein so that the twine 26 is impregnated with resin prior to winding on the yoke 42 as shown. Thus, the winding of the twine onto the yoke assembly is effectively a wet winding, with the amount of resin being suitably controlled by the viscosity thereof, and if required by additional guides, wipers, etc. In that regard, wet winding in general is well known, so that the achievement of a winding around the yoke assembly 42 which is sufficiently wet to be self-adhering and generally free significant voids, though not so wet as to be dripping resin, may be readily achieved by those skilled in the art. Preferably the number of turns on the yoke assembly should be substantial so that the effect of the start and finish of the twine on the finished winding are both relatively insignificant compared to the numerous turns therebetween, as both the start and the finish turn generally are weaker because of the free ends thereof. Accordingly, for this and other reasons, preferably at least ten turns are utilized. In particular, a relatively low number of turns result in a relatively course outer surface texture of the finished rope, whereas a larger number of turns such as a hundred turns sufficiently minimizes the effect of the start and finish turns and provides a satisfactory texture on the finished rope. Further, while greater numbers of turns will further result in a smoother finished rope, numbers of turns exceeding a thousand probably are not preferable, as they may be time consuming to form and result in an unnecessarily smooth rope. In that regard, in the winding operation schematically illustrated in FIG. 2, the wet winding process will proceed with the best uniformity if the rollers 38 are driven at a uniform speed and the yoke assembly 42 is torqued through a slip-clutch so as to take up the twine as it becomes available after impregnation. Complete or void free impregnation is not required however, as the resin acts primarily as a strand and rope surface finder and protector.

When the winding on the yoke assembly 42 is complete the twine is cut to form the finish of the winding, with the finish end either being tied in an appropriate location or merely buried in the winding so as to stay put and not unwind. Thereafter the shaping members 46 (see also FIG. 3) are removed from the supporting pins 44 and the straight sections of the wound loop are allowed to wind up on themselves as a result of the tendency of the twine making up the loop to unwind, as illustrated in FIG. 4. While different shaping members may be used on the end loops during this winding or twisting process, good results are obtained if the same shaping members as were used in the winding of FIG. 2 are used. (The shaping members illustrated in the figures are generally circular in cross section, though shaping members having a general configuration of an eyelet etc. may also be used). After the straight sections of the loop are allowed to wind around themselves as shown in FIG. 4, the resin is cured and the shaping members 46 removed giving the section of rope 50 having loops 52 at each end thereof as shown in FIG. 5. The resulting rope when connected between pins, hooks or the like utilizing the loops 52 at each end thereof exhibits a strength approaching that of the aggregate fiber strength which, for the synthetic filament material such as Kevlar, is exceedingly high in comparison to conventional rope materials. In addition, the flexible urethane aids in the abrasion resistance of the rope to yield good flexibility while substantially eliminating freying tendencies. Urethane also prevents penetration by foreign substances such as abrasive particles, etc. to prevent any mechanical or chemical deterioration from such sources during use. The rope, having good flexibility when using a suitable binder, retains its unusually high strength when being bent, such as around a pulley or winch drum, as the inherent twist in the fibers, built-in as a result of the method of manufacture, distributes the load among the filaments even when the rope is curved so as to minimize the tendency of progressive failure due to unequal filament loading. It is perhaps best to have some tension on the loop during the longitudinal windup thereof as shown in FIG. 4, to assure that the filaments within each turn of twine, and each turn of twine within the total winding, takes the same positions that they preferably would take during the loading of the resulting rope in use, and that the tensile loads distribute well across the cross-section of the rope. In that regard, it will be noted that not all turns of the twine have the same length, as may be seen in FIG. 3, though of course this difference in length is preserved quite well by the maintenance of the same shape of end loops in the process of FIG. 4 and in the resulting rope of FIG. 5, so that the load will be relatively well distributed without special precautions. Further, it is important that either the yoke 42 (FIG. 2) be particularly rigid so as to maintain the same separation between the shaping members 44 during the entire winding process in spite of the tension in twine 26 during winding, or alternatively shaping members 46 on one end of the yoke 42 be supported on a plate 54 slideably coupled to the yoke 42 so that the aggregate tension in the winding formed thereon may be increased by a hydraulic or pneumatic cylinder 56 in direct proportion to the number of turns on the winding at any time, so that each turn of the winding maintains the same tension throughout the winding process. Such an arrangement will avoid loss of tension in the first part of the winding as the total load on the yoke increases as the winding progresses. Also, if desired though not necessary, that same tension may be maintained during the twisting into rope as shown in FIG. 4, even with the ends being driven in rotation to give the desired twist, though it is preferable that such twist be substantially equal to that which it would have undergone had it been allowed to twist by itself under a no load condition. Finally, some further redistribution of load to equalize filament stresses during use may be achieved by loading the rope somewhat after the twisting of FIG. 4, and flexing the rope a few times such as pulling it back and forth over a pulley, prior to curing the resin.

It is apparent that the equipment described with respect to FIG. 2 is suitable for the manufacturing of rope in lengths of a few feet, or perhaps a few tens of feet, though would be unwieldy for the manufacture of rope in lengths approaching 100 feet or more. However, other forms of processing equipment may also be used, such as that shown schematically in FIG. 6. In this instance a coil 28 of the twine is used to supply the twine 26 through the system of rollers 34, 36 and 38 to a pair of cylinders 56, angularly inclined with respect to each other and each supported for rotation about its axis. The twine 26 is wound about the rollers 56 a number of times, after which it is passed over a drive wheel 58 and tied to itself to form one continuous loop of a length dependent primarily on the separation of the rollers 56 and the number of times it is looped therearound. Thereafter, by driving drive wheel 58 at a constant speed, the twine is feed through the resin application system and onto the loop, winding at a uniform rate to form the winding as desired, with the individual loops sliding upward on the drums 56 under the tension supplied by the drive wheel 58. Obviously it is apparent that while FIG. 6 illustrates the use of a pair of inclined drums or cylinders 56, individual pulleys or other suitable means could be used to form a relatively large number of loops so that rope of a substantial length could be manufactured in a relatively small manufacturing area. Further, as before, the cylinders 56 or the drive wheel 58 could be tensioned in such a manner so that the total tension on the winding is increased in accordance with the tension in the twine being fed to the winding and the number of turns at any stage of winding.

For some applications the rope of the present invention may be fabricated in the particular length desired so that a single length of rope is proper for the particular application. In most instances, however, the length of rope required will either vary from time-to-time or exceed the length which may be most conveniently manufactured. In such instances, multiple lengths of rope may be looped together at the ends as shown in FIG. 7. In that regard, one of the important aspects of the present invention is the flexibility of the rope, and more particularly the ability of the rope to maintain its strength when bent or flexed, which allows the looping of lengths of rope together as shown without substantial loss of strength over that exhibited by an individual length of the rope. In particular, while the twine forming the loop 52 at each end of the rope does not wind back around itself in the step of FIG. 4 as the center section of the rope does, the twist initially put into the twine, which of course exists in the twine forming the loop, helps distribute the load across the cross-section of the loop so that the reduction in strength caused by the looping of rope sections together as shown in FIG. 8 is minimized.

Figure 10:
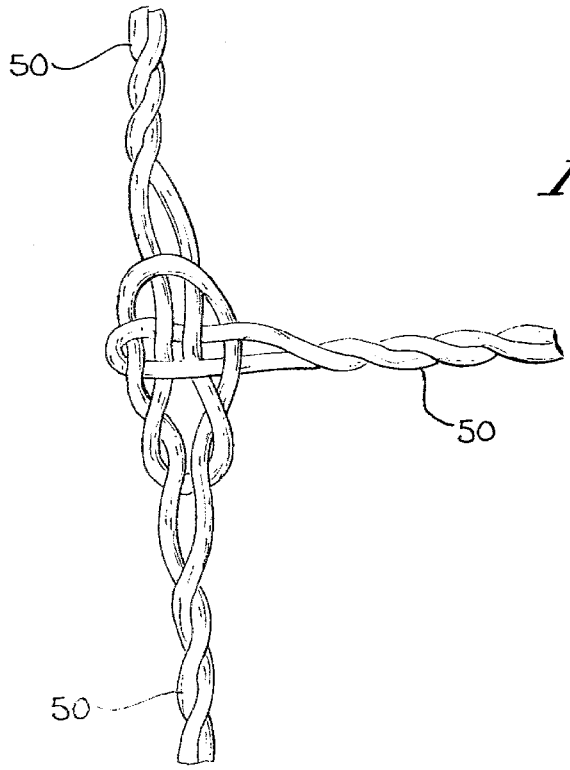
FIG. 10 is an illustration of one form of looping which may be used to form the intersections of the net-like structure of FIG. 8.

Now referring to FIG. 8, one other aspect of the present invention may be seen. In particular, individual sections of rope 50 of appropriate length may be looped together in a two dimensional pattern to form a net-like structure suitable for use in applications requiring a high strength, low weight net-like structure, such as by way of example, in the separation of cargo bays on commercial aircraft. Such two dimensional patterns may readily be formed using a plurality of relatively short sections of rope and any of a number of possible looping schemes. In particular, it should be noted that with respect to the inner area of the net wherein four individual sections of rope are looped together at each crossing, only two of the four, specifically two at right angles to each other, are preset as a result of previous looping, so that the junction of four may be readily formed with the two additional lengths of rope being free at both ends thereof for the looping operation. By way of specific example, one possible looping scheme for the inner junction of a net-like structure such as shown in FIG. 8 may be seen in FIG. 9. Such a looping scheme, while providing a somewhat larger knot-like structure at each junction, than may be necessary as a minimum and therefore may make a somewhat larger loop 52 at the end of each length of rope 50 more desirable; has a specific advantage that it loops the various lengths of rope together in such a way that tension along any axis tends to close all four loops in each junction under tension. For the sides where only three lengths of rope are joined, a looping scheme such as is illustrated in FIG. 10 may be used. Such a looping scheme also tends to close the loops rather than open them when under tension. Obviously, however, the specific looping schemes disclosed with respect to FIGS. 9 and 10 are exemplary only to illustrate but one possible looping scheme which, in fact, may be woven into the two dimensional configuration such as that shown in FIG. 8 and which has the further advantage of tending to close rather than open the loop on the ends of the rope. Because of the great flexibility in the rope and its ability to be looped in the manner described without substantial lose of potential strength thereof, exceptionally strong nets of the type described may be readily woven from relatively short sections of rope easily fabricated in accordance with the methods of the present invention. In that regard, the present invention is not specifically limited to only two dimensional patterns, as three dimensional patterns, such as by way of example only, a conical section may readily be formed of looped together sections of rope, either using rope sections of all the same length or various sections of differing lengths.

Having now described the basic manner of manufacturing and using the present invention, the details are one specific embodiment of rope will now be given. The particular rope may be made utilizing untwisted strands of 7500 Denier Kevlar filaments, giving approximately 4300 filaments per strand. Three such strands are combined (see FIG. 1) and twisted approximately 1.8 turns per linear inch to provide the twine subsequently used to make the rope. The twine in turn is wound with approximately 100 turns (see FIG. 2) after having been impregnated in Hughson 2257-14A&B manufactured by Hughson Chemicals, Division of Lord Corporation of Erie, Pennsylvania 16512, with the winding being done over shaping members of approximately 3-inch diameter and having an approximately circular profile. The resulting loop is then allowed to wind back on itself (FIG. 4) and cured to provide the resulting rope section (FIG. 5).

Having described the preferred embodiments, various other embodiments will now become apparent. Obviously, in the event strands of a suitable size are readily commercially available, multiple strands do not have to be combined prior to the twisting of FIG. 1. Also, where the specific application of the resulting rope is known, the ends may be specifically formed (wound as in FIG. 2) to provide the end shape desired so that when in use, the deflection of the end, depending upon the application, actually represents the "free state" of the rope end so that even the small drop in strength caused by such deflection is almost non-existance. By way of specific example, the looping illustrated with respect to FIG. 7 tends to deflect the loops somewhat, which deflection could effectively be built-in if desired by the appropriate shaping of the shaping members 46 (see FIG. 2). In that regard, however, it is to be noted that one aspect of the present invention is the unique flexibility of the resulting rope without undue loss in strength so that such shaping is not really necessary. Further, if the loop ends are to be subjected to unusual wear, additional material and/or an insert may be placed therein prior to or after curing of the urethane or other binder. In that regard, if permanent long lengths of the rope are desired, the looping of FIG. 7 (or even potentially the looping in two dimensional or three dimensional patterns) could be accomplished prior to the curing of the resin so as to permanently join the individual rope segments. While a highly flexible urethane binder has been disclosed herein as being preferred because of its flexiblity and chemical and abrasion resistance, other binders may also be used depending on the ultimate flexibility and other characteristics desired. Also, impregnation may be delayed until after the step of FIG. 2, or even after the twisting of FIG. 4, with or without total impregnation, of the entire rope cross-section. In general, though urethane binders are preferred, epoxy, latex, or other binders are also useable, depending on the intended application of the rope. By way of example, a suitable flexible epoxy is Bisphenol A type epoxy cured with a flexible hardener such as thiokol (manufactured by Thiokol), or a polyamide such as Versamid, (manufactured by General Mills). Also, other filaments such as graphite filaments or even lower strength filaments may be used, though the invention is particularly intended for nonmetallic filaments of high strength and small diameter. Thus, while the preferred embodiment has been disclosed and described herein with reference to certain preferred embodiments hereof, it will be understood by those skilled in the art that various changes in form and detail may be made therein without departing from the spirit and scope of the invention.

I claim:

1. A method of making rope-like structures comprising the steps of:

(a) providing a plurality of filaments in a continuous strand;

(b) twisting the strand about its axis through a predetermined angle per unit length to form a twine;

(c) winding the twine to provide a loop having a substantial number of turns of the twine, and (d) twisting the loop provided in step (c) about its axis in a direction opposite the direction of twist provided in step (b) to form the rope-like structure having loops at each end thereof.

2. The method of claim 1 further comprising the step of coating at least the outer portion of the rope-like structure with a flexible coating.

3. The method of claim 2 wherein the step of impregnating the rope-like structure with a binder is performed after step (d) of claim 1.

4. The method of claim 3 wherein the binder is a flexible urethane binder.

5. The method of claim 1 further comprised of the step of impregnating the strand formed in step (b) with an uncured urethane resin prior to performing step (c), and curing the resin after step (d).

6. The method of claim 1 wherein the continuous strand provided in step (a) is provided by combining a plurality of smaller substantially untwisted strands.

7. The method of claim 1 wherein the steps are repeated a number of times to form a number of rope-like structures, and further comprised of the steps of looping together a plurality of the rope-like structures to form a rope-like structure of increased length.

8. The method of claim 1 wherein the steps are repeated a number of times to form a number of rope-like structures, and further comprised of the steps of impregnating the strand formed in step (b) with an uncured resin prior to performing step (c), looping together a plurality of rope-like structures to form a longer rope-like structure, and then curing the resin.

9. The method of claim 8 wherein the uncured resin is a flexible urethane resin.

10. The method of claim 1 wherein the filaments provided in step (a) are synthetic fiber filaments.

11. The method of claim 1 wherein the number of turns formed in step (c) is at least ten.

12. The method of claim 11 wherein the number of turns is less than one thousand.

13. The method of claim 1 wherein the number of turns formed in step (c) is approximately one hundred.

14. A method of making rope-like structures comprising the steps of:

(a) providing a plurality of synthetic filaments in a continuous strand;

(b) twisting the strand about its axis through a predetermined angle per unit length to form a twine;

(c) wet winding the twine with an uncured resin to provide a loop having a substantial number of turns of the twine;

(d) twisting the loop provided in step (c) about its axis in a direction opposite the direction of twist provided in step (b) to form the rope-like structure having loops at each end thereof, and (e) curing the resin.

15. The method of claim 14 wherein the resin is a flexible urethane resin.

16. A rope-like structure comprising a central section having a continuous loop at each end thereof formed of a substantial number of turns of twine, said twine being comprised of a substantial number of individual continuous filaments collectively twisted about the axis of said twine, said central section of said rope-like structure being twisted in a direction opposite the direction of twist in said twine, said rope-like structure having flexible a binder coating at least the outer fibers thereof.

17. The structure of claim 16 wherein said binder is a flexible urethane binder.

18. The structure of claim 16 wherein said binder extends substantially through the cross-section of said rope-like structure.

19. A rope comprised of a plurality of rope-like structures, each having a central section having a continuous loop at each end thereof formed of a substantial number of turns of twine, said twine being comprised of a substantial number of individual continuous filaments collectively twisted about the axis of said twine, said central section of said rope-like structure being twisted in a direction opposite the direction of twist in said twine, said rope-like structure having a flexible binder coating at least the outer fibers thereof, said rope-like structures being looped together to form the rope having a length greater than that of the individual rope-like structures by an amount dependent on the number of rope-like structures looped together.

20. The structure of claim 19 wherein said binder is a flexible urethane binder.

21. The structure of claim 19 wherein said binder extends substantially through the cross-section of said rope-like structure.

22. A multi-dimensional article comprising a plurality of rope-like structures, each having a central section having a continuous loop at each end thereof formed of a substantial number of turns of twine, said twine being comprised of a substantial number of individual continuous filaments collectively twisted about the axis of said twine, said central section of said rope-like structure being twisted in a direction opposite the direction of twist in said twine, said rope-like structure having a binder coating at least the outer fibers thereof the ends of said rope-like structures being looped together in a predetermined pattern to form the multi-dimensional article.

23. The structure of claim 22 wherein said binder is a flexible urethane binder.

24. The structure of claim 22 wherein said binder extends substantially through the cross-section of each of said rope-like structures.

25. A method of making rope-like structures comprising the steps of:

(a) providing a plurality of filaments in a continuous strand;

(b) twisting the strand about its axis through a predetermined angle per unit length to form a twine;

(c) winding the twine to provide a loop having a substantial number of turns of the twine;

(d) twisting the loop provided in step (c) about its axis in a direction opposite the direction of twist provided in step (b) to form the rope-like structure having loops at each end thereof;

(e) repeating steps (a) through (d) a number of times to form a number of rope-like structures; and (f) looping together a plurality of the rope-like structures to form a multi-dimensional pattern.

26. A method of making rope-like structures comprising the steps of:

(a) providing a plurality of filaments in a continuous strand;

(b) twisting the strand about its axis through a predetermined angle per unit length to form a twine;

(c) impregnating the twine with an uncured resin;

(d) winding the twine to provide a loop having a substantial number of turns of the twine;

(e) twisting the loop provided in step (d) about its axis in a direction opposite the direction of twist provided in step (b) to form the rope-like structure having loops at each end thereof;

(f) repeating steps (a) through (e) a number of times to form a number of rope-like structures;

(g) looping together a plurality of rope-like structures to form a multi-dimensional pattern; and (h) curing the resin.

27. The method of claim 25 wherein the multi-dimensional pattern is a two-dimensional net like pattern having a grid spacing substantially equal to the length of individual rope-like structures.

28. The method of claim 26 wherein the uncured resin is a flexible urethane resin.

29. The method of claim 28 wherein the multi-dimensional pattern is a two-dimensional net like pattern having a grid spacing substantially equal to the length of individual rope-like structures.

30. The method of claim 26 wherein the multi-dimensional pattern is a two-dimensional net like pattern having a grid spacing substantially equal to the length of the individual rope-like structures.

31. A method of making rope-like structures comprising the steps of:

(a) providing a plurality of filaments in a continuous strand;

(b) twisting the strand about its axis through a predetermined angle per unit length to form a twine;

(c) winding the twine to provide a loop having a substantial number of turns of the twine;

(d) twisting the loop provided in step (c) about its axis in a direction opposite the direction of twist provided in step (b) to form the rope-like structure having loops at each end thereof;

(e) repeating steps (a) through (d) a number of times to form a number of rope-like structures; and (f) looping together a plurality of the rope-like structures to form a rope having a length greater than that of the individual rope-like structures by an amount dependent on the number of rope-like structures looped together.

32. A method of making rope-like structures comprising the steps of:

(a) providing a plurality of filaments in a continuous strand;

(b) twisting the strand about its axis through a predetermined angle per unit length to form a twine;

(c) impregnating the twine with an uncured resin which will remain flexible when cured;

(d) winding the twine to provide a loop having a substantial number of turns of the twine;

(e) twisting the loop provided in step (d) about its axis in a direction opposite the direction of twist provided in step (b) to form the rope-like structure having loops at each end thereof;

(f) repeating steps (a) through (e) a number of times to form a number of rope-like structures;

(g) looping together a plurality of rope-like structures to form a rope having a length greater than that of the individual rope-like structures; and (h) curing the resin.

33. The rope of claim 19 wherein said flexible binder substantially permeates each of said rope-like structures.

34. The rope of claim 33 wherein said flexible binder binds each rope-like structure to the adjacent rope-like structures to which it is coupled to.

* * * * *